US011421492B2

(12) United States Patent
Rivas Martinez et al.

(10) Patent No.: US 11,421,492 B2
(45) Date of Patent: Aug. 23, 2022

(54) METHOD AND APPARATUS OF SMART LANDING NIPPLE SYSTEM

(71) Applicant: SAUDI ARABIAN OIL COMPANY, Dhahran (SA)

(72) Inventors: Mario Augusto Rivas Martinez, Dhahran (SA); Monty B. Gilleland, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/003,004

(22) Filed: Aug. 26, 2020

(65) Prior Publication Data

US 2022/0065060 A1 Mar. 3, 2022

(51) Int. Cl.

| | |
|---|---|
| ***E21B 23/02*** | (2006.01) |
| ***E21B 47/09*** | (2012.01) |
| ***E21B 47/13*** | (2012.01) |
| ***E21B 47/07*** | (2012.01) |
| ***E21B 47/06*** | (2012.01) |

(52) U.S. Cl.
CPC ..... *E21B 23/02* (2013.01); *E21B 47/06* (2013.01); *E21B 47/07* (2020.05); *E21B 47/09* (2013.01); *E21B 47/13* (2020.05)

(58) Field of Classification Search
CPC ..... E21B 23/02; E21B 47/06; E21B 47/07; E21B 47/09
See application file for complete search history.

(56) References Cited

U.S. PATENT DOCUMENTS

| | | | |
|---|---|---|---|
| 2,846,014 | A | 8/1958 | Daffin et al. |
| 4,294,315 | A | 10/1981 | Yonker et al. |
| 4,867,237 | A | 9/1989 | Wilson et al. |
| 4,997,043 | A | 3/1991 | Pringle |
| 6,497,280 | B2 | 12/2002 | Beck et al. |

(Continued)

FOREIGN PATENT DOCUMENTS

WO 0173423 A1 10/2001

OTHER PUBLICATIONS

International Search Report and Written Opinion issued in Application No. PCT/US2020/053041, dated Apr. 29, 2021 (13 pages).

*Primary Examiner* — Robert E Fuller
*Assistant Examiner* — Lamia Quaim
(74) *Attorney, Agent, or Firm* — Osha Bergman Watanabe & Burton LLP

(57) ABSTRACT

A method includes running a lock mandrel into a subterranean wellbore, setting the lock mandrel in a landing nipple located at a specified depth in the subterranean wellbore, acquiring data within a control unit, the data including information regarding a position of the lock mandrel in the landing nipple, transmitting the data in real time from the control unit to a surface of the wellbore, and determining a position of the lock mandrel in the landing nipple based on the transmitted data. An apparatus includes a landing nipple having an internal locking profile, a lock mandrel having an external locking profile configured to engage the internal locking profile of the landing nipple, a sensor coupled to the landing nipple, and a control unit coupled to the landing nipple and configured to receive data from the sensor and transmit the received data to a surface of the wellbore in real time.

20 Claims, 5 Drawing Sheets

(56) References Cited

U.S. PATENT DOCUMENTS

| | | | | |
|---|---|---|---|---|
| 2010/0212891 | A1 | 8/2010 | Stewart et al. | |
| 2014/0000864 | A1* | 1/2014 | Fielder, III | E21B 43/128 166/65.1 |
| 2014/0273831 | A1* | 9/2014 | Walton | E21B 43/119 455/41.1 |
| 2014/0338896 | A1 | 11/2014 | McGarian et al. | |
| 2016/0024858 | A1 | 1/2016 | Hanton et al. | |
| 2016/0340991 | A1* | 11/2016 | White | E21B 23/01 |
| 2018/0188413 | A1* | 7/2018 | Capoglu | G01V 3/28 |
| 2019/0063213 | A1 | 2/2019 | Donderici et al. | |
| 2020/0240220 | A1* | 7/2020 | DeBerry | E21B 19/165 |

* cited by examiner

METHOD AND APPARATUS OF SMART LANDING NIPPLE SYSTEM

BACKGROUND

Completion operations in the oil and gas industry include the procedures and equipment needed to bring a wellbore into production after drilling operations have ended. Downhole tubulars and equipment are assembled and lowered downhole to allow for safe and efficient production from the oil or gas well. Completion equipment may include tubulars, packers, perforated pipe, pumps, plugs, gauges, valves, etc. A slickline, a cable or single-strand wireline, may be used to run and retrieve tools and equipment in the well.

Slickline plugs or lock mandrels and landing nipples are used in completion operations and are configured to provide mechanical isolation of the well (a well control mechanical isolation barrier) to prevent downhole fluids and downhole pressures from coming up the well while performing surface work on the wellhead. A landing nipple is a section of tubular with a machined internal surface that provides a seal area and a locking profile. Landing nipples may be provided at various locations along a length of a wellbore to allow for the installation of flow control devices for isolation of sections of the well. The flow control devices may include, for example, plugs, chokes, or lock mandrels. The flow control device is inserted in the landing nipple and engages the locking profile and provides a seal against the seal area of the landing nipple.

There are several types of slickline plugs or lock mandrels and landing nipple profiles available from various manufacturers, for example, X®, XN®, R®, RN®, FBN®, RPT®, SRP, RQ, RPV. The N designates no-go nipples, which is a landing nipple that has a reduced diameter internal profile to prevent a set tool or device from passing through the nipple. The X® and R® landing nipples may be run into the well on completion tubing to provide a specific landing location for slickline plugs. The X® landing nipple may be used in standard weight tubing and the R® landing nipple is typically used with heavyweight tubing. The XN® and RN® no-go landing nipples and slickline plugs are designed for use in single nipple installations or as the bottom nipple in a series of X® or R® landing nipples. These landing nipples have the same packing bore inner diameter for a particular tubing size and weight. X® and XN® landing nipples are designed for use with standard weight tubing.

SUMMARY

In one aspect, embodiments disclosed herein relate to a method that includes running a lock mandrel into a subterranean wellbore, setting the lock mandrel in a landing nipple located at a specified depth in the subterranean wellbore, acquiring data within a control unit, the data including information regarding a position of the lock mandrel in the landing nipple, transmitting the data in real time from the control unit to a surface of the wellbore, and determining a position of the lock mandrel in the landing nipple based on the transmitted data.

In another aspect, embodiments disclosed herein relate to an apparatus that includes a landing nipple having an internal locking profile, a lock mandrel having an external locking profile configured to engage the internal locking profile of the landing nipple, a sensor coupled to the landing nipple, and a control unit coupled to the landing nipple and configured to receive data from the sensor and transmit the received data to a surface of the wellbore in real time, wherein signal transmissions between the sensor and the control unit are configured to be activated and deactivated.

In yet another aspect, embodiments disclosed herein relate to a method that includes running a lock mandrel into a subterranean wellbore, positioning the lock mandrel in a landing nipple located at a specified depth in the subterranean wellbore, transmitting a signal to a control unit coupled to the landing nipple to activate data acquisition from a sensor disposed on the landing nipple, acquiring data representative of a pressure or a strain associated with the landing nipple form the sensor, transmitting the data representative of the pressure or the strain associated with the landing nipple to a system at a surface of the wellbore in real time, and determining, based on the data representative of the pressure or the strain associated with the landing nipple, a position of the lock mandrel within the landing nipple.

Other aspects and advantages of the invention will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
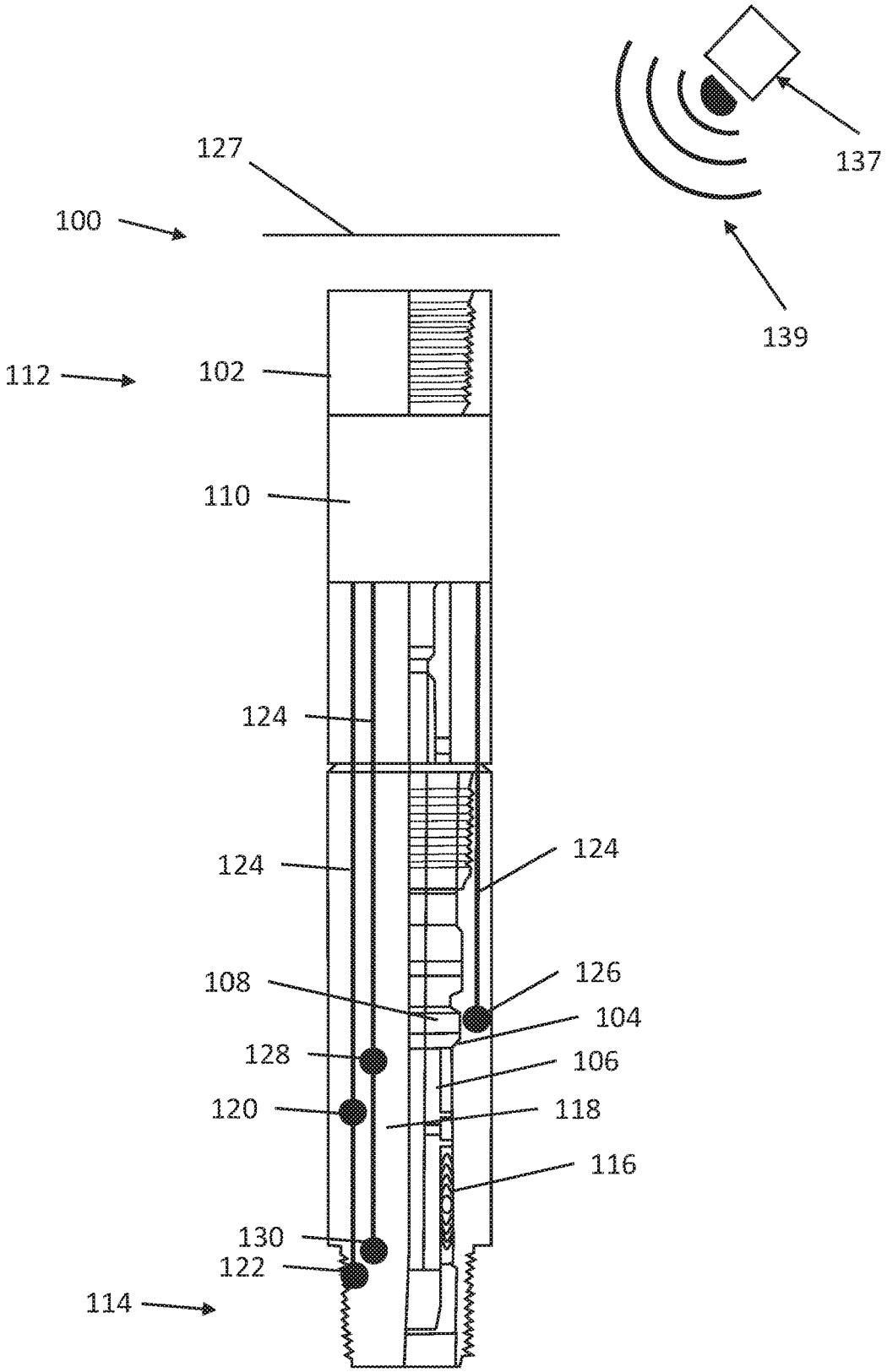
FIG. 1 is a schematic of a smart landing nipple system, partially broken away, in accordance with embodiments disclosed herein.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. For the sake of continuity, and in the interest of conciseness, same or similar reference characters may be used for same or similar objects in multiple figures.

Embodiments disclosed herein are directed to a method and an apparatus for improving the verification of a correct setting or landing of different types of slickline plugs or lock mandrels inside corresponding landing nipples. The method and apparatus diagnose and verify the correct landing of the slickline plug/lock mandrel inside the landing nipple in real time. Additionally, embodiments disclosed herein are directed to a method and an apparatus for detecting pressures above and below the plug or lock mandrel seals and the landing nipple and for detecting temperatures above and below the lock mandrel seals and the landing nipple.

Embodiments disclosed herein further relate to an apparatus that includes a smart, automated landing nipple that activates and deactivates signal transmission between diagnostic equipment and a system provided at the surface of the wellbore an unlimited number of times to provide a full diagnostic of the equipment and relevant conditions (e.g., plug, lock mandrel, landing nipple, pressures, temperatures) in real time to the surface. Embodiments disclosed herein also relate to a method that includes detecting a setting of the slickline plug/lock mandrel on the landing nipple profile, detecting pressures above and below the lock mandrel and the landing nipple, and detecting temperatures above and below the lock mandrel and the landing nipple. In accordance with one or more embodiments, automation of verification of the proper setting of a plug or lock mandrel in a corresponding landing nipple as described herein may improve the efficiency of setting of the slickline plugs/lock mandrels on the landing nipples, avoid miss-setting of the slickline plugs/lock mandrels, avoid additional slickline trips for checking the correct setting of the slickline plug/lock mandrel (check set runs), and avoid dropping of slickline plugs/lock mandrels due to poor setting inside the landing nipples which can lead to costly fishing operations.

Generally, a completion system may have as many selective nipples with the same inner diameter in any sequence as desired on a tubing string to allow an unlimited number of positions for setting and locking slickline plugs/lock mandrels. The slickline plugs/lock mandrels are run in the well via a selective running tool on a slickline. The slickline operator using the selective running tool can set the slickline plug in any one of the landing nipples at the desired depth. The slickline operator may change the location and move the slickline plug up or down the tubing to another nipple location. Setting and unsetting of the slickline plug/lock mandrel is performed mechanically by running and setting the slickline plug/lock mandrel and pulling up of the slickline to raise the slickline plug/lock mandrel, respectively. Methods in accordance with embodiments disclosed herein may be used to diagnose and verify the proper setting of one or more slickline plugs/lock mandrels in one or more landing nipples in real time as the slickline plug/lock mandrel is run down hole, reset the slickline plug/lock mandrel if it is determined the slickline plug/lock mandrel is mis-set, and diagnose and verify the proper setting of one or more slickline plugs/lock mandrels in one or more landing nipples in real time as the slickline plug/lock mandrel is re-set. Further, methods and apparatus in accordance with embodiments disclosed herein may be used with any slickline plug/lock mandrel and landing nipple profile or configuration in the industry.

A smart landing nipple system in accordance with one or more embodiments disclosed herein may provide a closed loop system that delivers to the surface a full diagnostic of the landing nipple and slickline plug/lock mandrel in real time to identify any potential failures while setting the slickline plug/lock mandrel. A smart landing nipple system in accordance with one or more embodiments disclosed herein may include a landing nipple, a corresponding slickline plug or lock mandrel, one or more sensors, and a control unit that provides an interface between the landing nipple and a system at the well surface. The control unit may include transmitters and receivers that acquire data from the one or more sensors and manage the information between the surface and the landing nipple. The control unit may act as part of a smart system to allow for multiple remote activation and deactivation of signal transmissions by, for example, Wi-Fi transmission or electromagnetics, to acquire the data from the sensors at select times or intervals. The one or more sensors may include a position sensor, such as a piezoelectric sensor or microstrain sensor that detects or identifies when the slickline plug/lock mandrel has landed on inside the landing nipple and on top of the landing nipple profile. The one or more sensors may also include pressure sensors to detect real time internal pressures above and below the landing nipple (e.g., above and below a sealing element or packing element) or to ensure full isolation between an area below the landing nipple and an area above the landing nipple. The one or more sensors may also include temperature sensors installed to detect real time internal temperatures above and below the landing nipple (e.g., above and below a sealing element or packing element). In the interest of conciseness, embodiments disclosed herein may refer to a slickline plug or a lock mandrel; however, a person of ordinary skill in the art will appreciate that embodiments disclosed herein may apply equally to slickline plugs and lock mandrels.

Referring to FIG. 1, a schematic of a smart landing nipple system 100 in accordance with embodiments disclosed herein is shown. The system 100 includes a landing nipple 102 having an internal locking profile 104 and a lock mandrel 106 having an external locking profile 108 configured to engage the internal locking profile 104 of the landing nipple 102. A sealing element, such as a packer or packing element 116, may be coupled to the lock mandrel 106 and configured to engage with an internal surface of the landing nipple 102. As shown in FIG. 1, in some embodiments, the packing element 116 may be disposed around a lower, outer circumferential portion of the lock mandrel 106. When the lock mandrel 106 is set within the landing nipple 102, the packing element 116 is also set so that it is compressed and radially expanded into sealing engagement with the internal surface of the landing nipple 102.

The system 100 also includes a control unit 110 coupled to the landing nipple 102. In one embodiment, the control unit 110 may be connected directly to the landing nipple 102, either at an upper end 112 or a lower end 114 of the landing nipple 102. In other embodiments, the control unit 110 may be integral to or incorporated within the landing nipple 102 such that the landing nipple 102 and the control unit 110 form a single tool. The control unit 110 includes receivers and transmitters. The receivers are configured to receive signals from a surface of the well and one or more sensors associated with the landing nipple, as discussed below. The transmitters are configured to transmit signals from the control unit downhole to the surface.

The landing nipple 102 includes at least one sensor in accordance with embodiments disclosed herein. In one embodiment, the landing nipple 102 includes a position sensor such as a microstrain sensor 126 or strain gauge to determine when the lock mandrel 106 has landed inside the internal locking profile 104 of the landing nipple 102. For example, the sensor may be a piezoelectric sensor that can detect when the lock mandrel 106 has landed inside the internal locking profile 104 of the landing nipple 102 by measuring strain changes in the landing nipple 102 as the lock mandrel 106 contacts the landing nipple 102 (i.e., when the external locking profile 108 engages the internal locking profile 104). The microstrain sensor 126 or strain gauge may be disposed on an external portion of the landing nipple 102. In one embodiment, the microstrain sensor 126 may be disposed on an external portion of the landing nipple 102 radially outward from the internal locking profile 104. The microstrain sensor 126 or strain gauge may transmit measured strain data to the control unit 110 via a cable 124, wire, or other methods known in the art. The strain data may then be transmitted in real time from the control unit to a surface 127 of the well. The microstrain sensor 126 may be used to determine a position of the lock mandrel 106 in the landing nipple 102. In other words, the strain data measured by the microstrain sensor 126 indicates if the lock mandrel 106 is in contact with a specific area of the landing nipple 102, for example with the internal locking profile 104, and therefore indicates whether the lock mandrel 106 is correctly set within the landing nipple 102.

In some embodiments, more than one microstrain sensor 126 may be disposed on an external portion of the landing nipple 102 to indicate the position of the lock mandrel 106 in the landing nipple 102. For example, two or more microstrain sensors 126 may be positioned at different locations around a circumference of the landing nipple 102. The two or more microstrain sensors 126 may be positioned radially outward from the internal locking profile 104. Additional microstrain sensors 126 may be positioned along an axial length of the landing nipple 102. The strain data measured by the two or more microstrain sensors 126 may then be transmitted to the control unit 110 and to the surface 127 of the well. The measured strain data may indicate the position of the lock mandrel 106 within the landing nipple by measuring the strain at each location of the microstrain sensors 126. Measured strain data that shows a strain of the landing nipple 102 indicates engagement of the lock mandrel 106 with the landing nipple 102 proximate the microstrain sensor 126, whereas measured strain data that shows no strain of the landing nipple 102 indicates the lock mandrel 106 is not engaged with the landing nipple 102 proximate the microstrain sensor 126. Thus, the measured strain data may indicate that the lock mandrel 106 is fully set, offset, or angled within the internal locking profile 104 of the landing nipple. In one or more embodiments, other types of position sensors may be used to indicate a position of the lock mandrel 106 within the landing nipple 102 without departing from the scope of embodiments herein.

In one or more embodiments, the landing nipple 102 may include a pressure sensor disposed on an inner portion 118 of the landing nipple 102. The pressure sensor is configured to detect an internal pressure of the landing nipple and transmit pressure data to the control unit 110 via a cable 124, wire, or other methods known in the art. The pressure data may then be transmitted in real time from the control unit to a surface 127 of the well. The pressure data may be used to determine an internal pressure above, below, or above and below the landing nipple 102.

In some embodiments, the landing nipple 102 may include a first pressure sensor 120 and a second pressure sensor 122. The first pressure sensor 120 may be disposed on the inner portion 118 of the landing nipple 102 at a first axial location above the packing element 116 when the lock mandrel 102 is set in the landing nipple. The second pressure sensor 122 may be disposed on the inner portion 118 of the landing nipple 102 at a second axial location below the packing element 116 when the lock mandrel 106 is set in the landing nipple 102. The first pressure sensor 120 may detect an internal pressure above the packing element 116 in the landing nipple 102 and the second pressure sensor 120 may detect an internal pressure below the packing element 116 in the landing nipple 102. The pressure data from the first pressure sensor 120 and the second pressure sensor 122 may be transmitted to the control unit 120 via a cable 124, wire, or other methods known in the art. The pressure data may then be transmitted in real time from the control unit 110 to the surface 127 of the well. The pressure data may be used to determine a pressure above, below, or above and below the landing nipple 102, a pressure differential across the packing element 116, or a position of the lock mandrel 106 within the landing nipple 102, as discussed in more detail below.

In one or more embodiments, the landing nipple 102 may include a temperature sensor disposed on an inner portion 118 of the landing nipple 102. The temperature sensor is configured to detect an internal temperature of the landing nipple and transmit temperature data to the control unit 110 via a cable 124, wire, or other methods known in the art. The temperature data may then be transmitted in real time from the control unit to a surface 127 of the well. The temperature data may be used to determine an internal temperature above, below, or above and below the landing nipple 102.

In some embodiments, the landing nipple 102 may include a first temperature sensor 128 and a second temperature sensor 130. The first temperature sensor 128 may be disposed on the inner portion 118 of the landing nipple 102 at a first axial location above the packing element 116 when the lock mandrel 106 is set in the landing nipple. The second temperature sensor 130 may be disposed on the inner portion 118 of the landing nipple 102 at a second axial location below the packing element 116 when the lock mandrel 106 is set in the landing nipple 102. The first temperature sensor 128 may detect an internal temperature above the packing element 116 in the landing nipple 102 and the second temperature sensor 120 may detect an internal temperature below the packing element 116 in the landing nipple 102. The temperature data from the first temperature sensor 128 and the second temperature sensor 130 may be transmitted to the control unit 120 via a cable 124, wire, or other methods known in the art. The temperature data may then be transmitted in real time from the control unit 110 to the surface 127 of the well. The temperature data may be used to determine a temperature above, below, or above and below the landing nipple 102, or a temperature differential across the packing element 116.

The smart landing nipple system 100 in accordance with embodiments disclosed herein may be configured to activate and deactivate signal transmissions between one or more sensors (e.g., 120, 122, 126, 128, 130) and the control unit 110. The activation and deactivation may be provided remotely by Wi-Fi transmission 139 or electromagnetic transmission from the surface of the well to the control unit 110 or the one or more sensors (e.g., 120, 122, 126, 128, 130). Thus, diagnostic data regarding the lock mandrel 106 and landing nipple 102, including for example, strain data, pressure data, and temperature data, may be transmitted from the sensors to the surface 127 of the well multiple times and in real time. Thus, in the event a lock mandrel 106 is determined not to be properly set within the landing nipple 102 based on the diagnostic data, the lock mandrel 106 may be unset and reset, and the signal transmissions reactivated to acquire new data representative of a new position (i.e., repositioned) of the lock mandrel 106.

Figure 2:
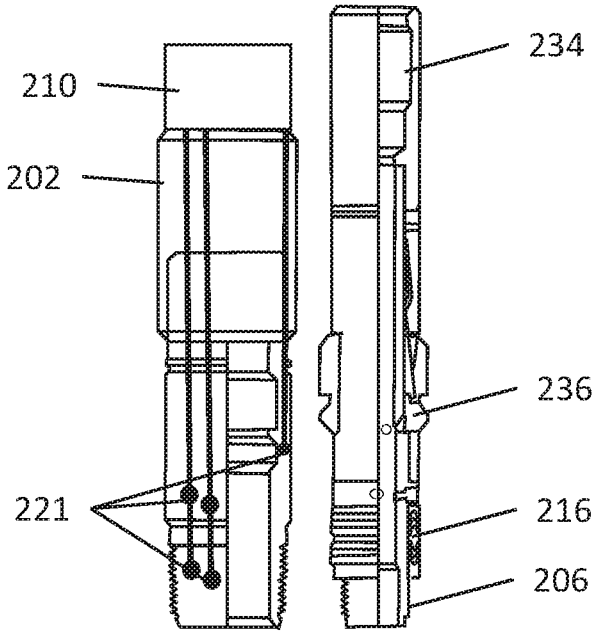
FIG. 2 is a schematic of a landing nipple and a corresponding lock mandrel of a smart landing nipple system, partially broken away, in accordance with embodiments disclosed herein.
Figure 3:
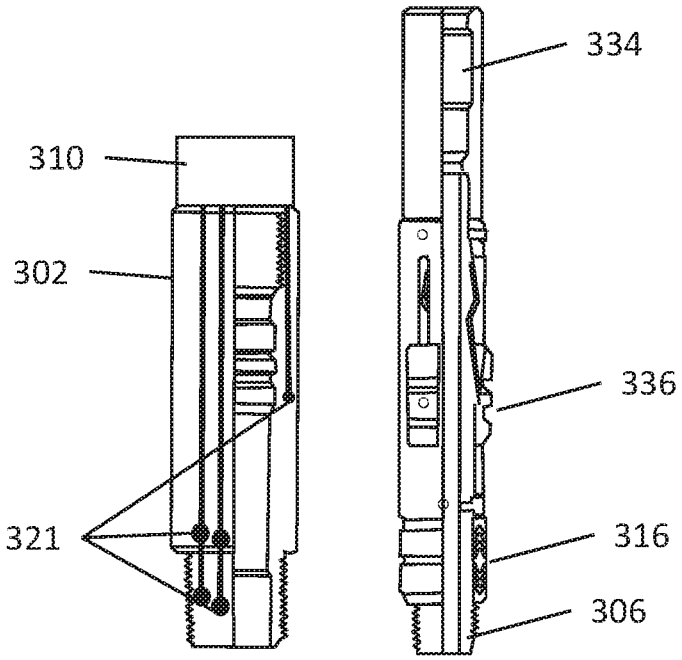
FIG. 3 is a schematic of a landing nipple and a corresponding lock mandrel of a smart landing nipple system, partially broken away, in accordance with embodiments disclosed herein.
Figure 4:
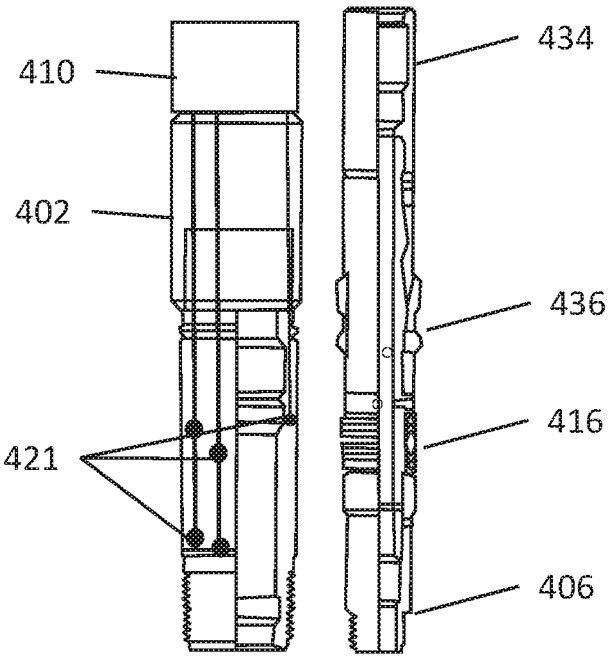
FIG. 4 is a schematic of a landing nipple and a corresponding lock mandrel of a smart landing nipple system, partially broken away, in accordance with embodiments disclosed herein.

As shown in FIGS. 2-5, landing nipples and lock mandrels may include a variety of configurations including, for example, variations in the components of the lock mandrel 206, the location of the packing elements 216, the inclusion of a fishing neck 234, reduced diameter internal profiles (no-go nipples), variations in locking profiles and locking keys 236, lengths, inner diameters, outer diameters, etc. The landing nipples and lock mandrels may be modified to include features and elements described herein such that the landing nipples and lock mandrels may be a component part of a smart landing nipple system in accordance with embodiments disclosed herein. For example, as shown in FIG. 2, a landing nipple 202 and a corresponding lock mandrel 206 may include one or more sensors 221 coupled to the landing nipple 202, as described above, and in communication with a control unit 210. The control unit 210 is coupled to the landing nipple 202 and configured to receive data from the one or more sensors and transmit the received data to a surface of the wellbore in real time. Remote activation and deactivation of signal transmissions may be provided between the control unit 210 and one or more sensors 221. The remote activation and deactivation may be provided by Wi-Fi transmission or electromagnetic transmission from the surface of the well to the control unit 210 or the one or more sensors 221. The landing nipple 202 and lock mandrel 206 shown in FIG. 2 are designed for use in standard weight tubing. FIG. 4 shows a landing nipple 402 and a lock mandrel 406 similar to that shown in FIG. 2 with the addition of a no-go sub 232.

Figure 5:
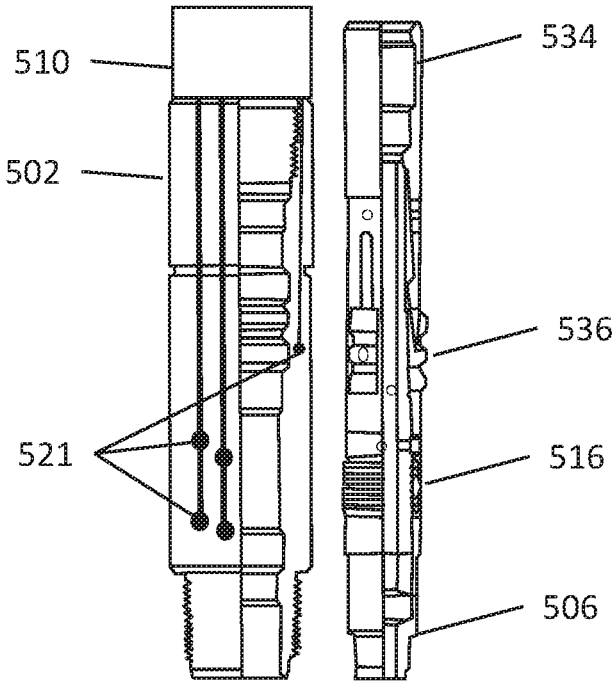
FIG. 5 a schematic of a landing nipple and a corresponding lock mandrel of a smart landing nipple system, partially broken away, in accordance with embodiments disclosed herein.

FIG. 3 shows a landing nipple 302 and a lock mandrel 306. The landing nipple 302 is configured to be run in the well on completion tubing and may be used with heavy-weight tubing. FIG. 5 shows a landing nipple 502 and a lock mandrel 506 similar to that shown in FIG. 3 with the addition of a no-go sub.

As discussed with respect to FIG. 2, the landing nipples in FIGS. 3-5 may also include one or more sensors 321, 421, 521, respectively, coupled to the landing nipple 302, 402, 502, and in communication with a control unit 310, 410, 510, respectively. The control unit 310, 410, 510 is coupled to the landing nipple 302, 402, 502 and configured to receive data from the one or more sensors and transmit the received data to a surface of the wellbore in real time. The activation and deactivation of signal transmissions between the control unit 310, 410, 510 and one or more sensors 321, 421, 521 may be provided remotely. The remote activation and deactivation may be provided by Wi-Fi transmission or electromagnetic transmission from the surface of the well to the control unit 310, 410, 510 or the one or more sensors 321, 421, 521.

Figure 6:
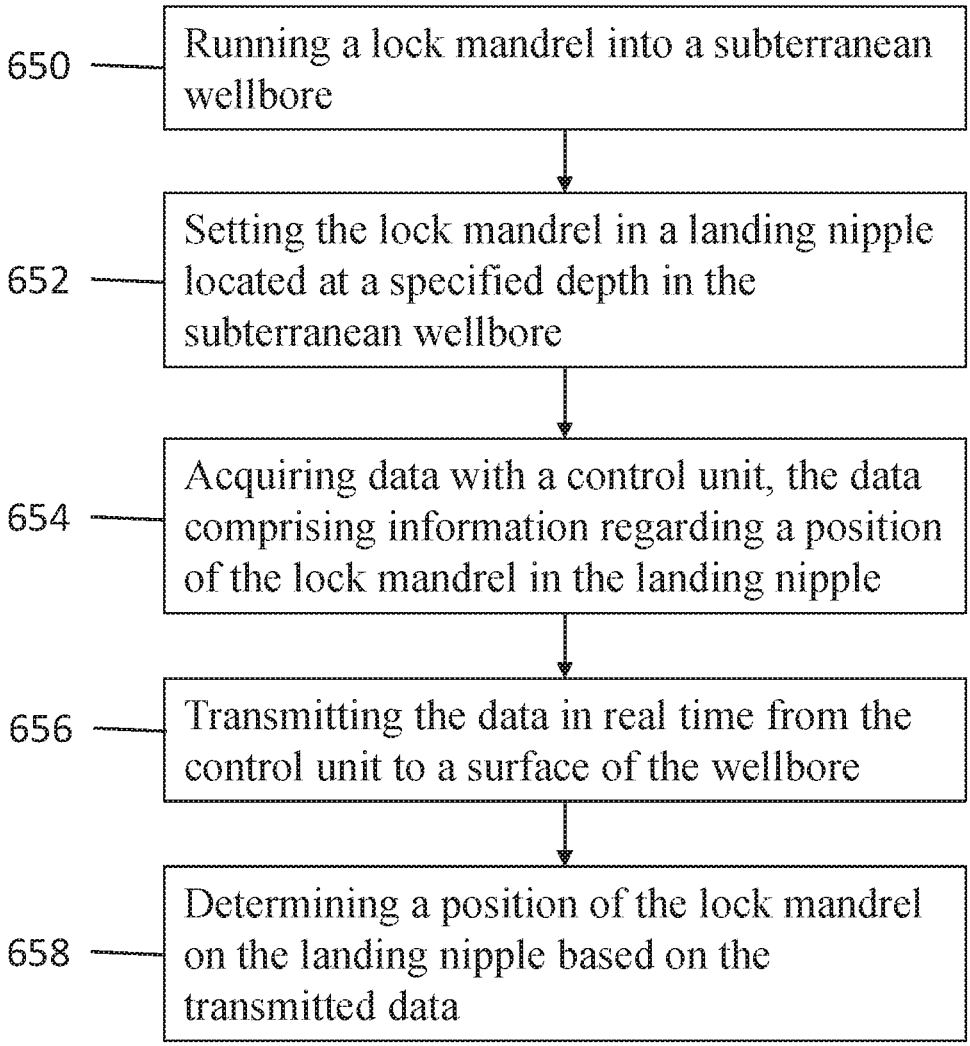
FIG. 6 is a flow chart of a method in accordance with embodiments disclosed herein.

In one or more embodiments, a method is disclosed that allows for diagnosing and verification of the proper setting of one or more slickline plugs or lock mandrels in one or more landing nipples in real time as the slickline plug or lock mandrel is run down hole into a landing nipple. FIG. 6 shows a method in accordance with embodiments disclosed herein. As shown with reference to FIGS. 1 and 6 together, the method includes running a lock mandrel 106 into a subterranean wellbore, as shown at 650, and setting the lock mandrel 106 in a landing nipple 102 located at a specified depth in the subterranean wellbore, as shown at 652. A control unit 110 acquires data comprising information regarding a position of the lock mandrel 106 in the landing nipple 102, as shown at 654. For example, the control unit 110 may acquire data from one or more sensors disposed on the landing nipple 102.

As discussed above, in some embodiments, the one or more sensors may include a position sensor, such as a microstrain sensor 126 or strain gauge disposed on an external portion of the landing nipple 102. The microstrain sensor 126 may be positioned radially outward from the internal locking profile 104 of the landing nipple 102 and configured to detect a strain in the landing nipple 102 when the lock mandrel 106 is set in the landing nipple 102, e.g., when the external locking profile 108 of the lock mandrel 106 engages the internal locking profile 104 of the landing nipple 102. In other words, the microstrain sensor 126 detects contact of the lock mandrel 106 on the landing nipple 102 internal locking profile 104 and provides strain data to the control unit 110.

In one or more embodiments, the one or more sensors may include a pressure sensor. As shown in FIG. 1, two pressure sensors 120, 122 may be disposed on an inner portion of the landing nipple. The first pressure sensor 120 may be disposed at a first axial location above the packing element when the lock mandrel 106 is set in the landing nipple 102 and a second pressure sensor 122 may be disposed at a second axial location below the packing element when the lock mandrel 106 is set in the landing nipple 102. The pressure sensors 120, 122 provide internal pressure data of the landing nipple 102 to the control unit 110.

The activation and deactivation of signal transmissions between the sensor and control unit and from the control unit to a system 137 at the surface of the wellbore may be remotely controlled and repeated as necessary. Thus, the data from the one or more sensors may be transmitted in real time from the control unit to the surface of the wellbore, as shown at 656. As the lock mandrel 106 is run down hole, and set in the landing nipple 102, the signal transmissions are activated such that the one or more sensors detect a condition of the tool or the wellbore, the control unit 110 receives the signal representative of the data detected by the one or more sensors, and transmits the data to the surface in real time. A position of the lock mandrel 106 in the landing nipple 102 may be determined, as shown at 658, based on the transmitted data. For example, the data from the microstrain sensor 126 indicates whether the landing nipple 102 experiences strain proximate a specified microstrain sensor 126 which indicates that the external profile 108 of the lock mandrel 106 engaged the internal profile 104 of the landing nipple 102. If strain of the landing nipple 102 is not detected, then it may be determined that the lock mandrel 106 has not fully or correctly engaged with the internal locking profile 104 of the landing nipple 102 and is therefore incorrectly set or mis-set. In one or more embodiments, multiple microstrain sensors 126 may be positioned around the landing nipple such that the strain data may more clearly indicate the position of the lock mandrel 106, e.g., if the lock mandrel 106 is offset or angled within the landing nipple 102.

In some embodiments, the data from the pressure sensors 120, 122 may be used to determine a position of the lock mandrel 106, and particularly whether the lock mandrel 106 is properly set within the landing nipple 102. For example, the pressure sensors may provide for determining isolation of the well below the landing nipple from above the landing nipple. If the pressure data indicates that the well is not isolated across the landing nipple (e.g., changing pressures above and below the landing nipple), it may be determined that the lock mandrel 106 is not correctly positioned in the landing nipple 102 to effect a full seal. Thus, the method also includes identifying any potential failures during setting of the lock mandrel 106 in the landing nipple 102.

A method in accordance with embodiments disclosed herein may further include determining a first temperature above the landing nipple 102 and a second temperature below the landing nipple 102. As discussed above, one or more temperature sensors may be disposed on an inner portion of the landing nipple to detect an internal temperature of the landing nipple. As shown in FIG. 1, two temperature sensors 128, 130 may be disposed on an inner portion of the landing nipple 102. The first temperature sensor 128 may be disposed at a first axial location above the packing element 116 when the lock mandrel 106 is set in the landing nipple 102 and a second temperature sensor 130 may be disposed at a second axial location below the packing element 116 when the lock mandrel 106 is set in the landing nipple 102. The temperature sensors 128, 130 provide temperature data to the control unit 110. The remote activation and deactivation of signal transmissions between the temperature sensors and the control unit and from the control unit to a system at the surface of the wellbore may be repeated as necessary.

Figure 7:
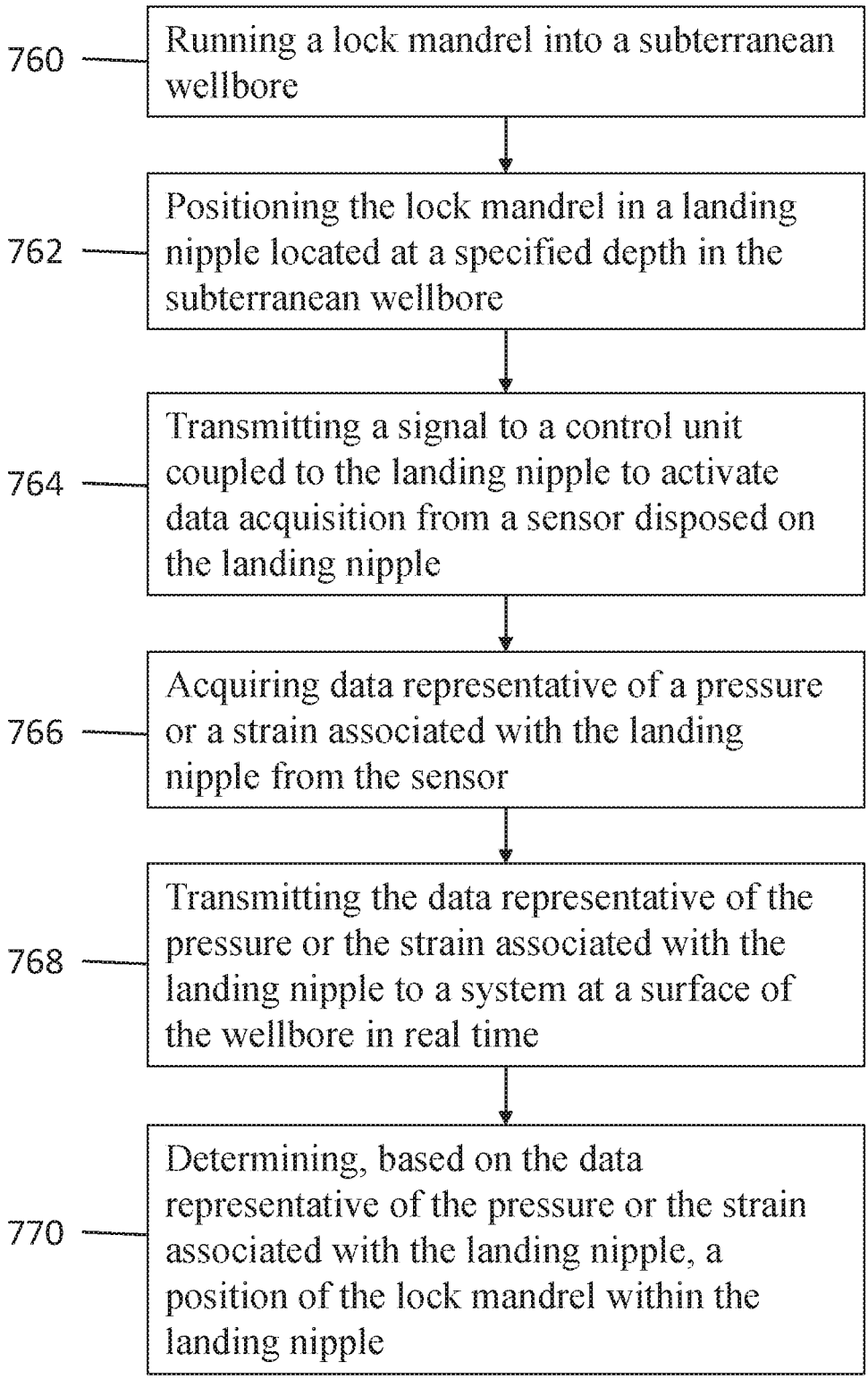
FIG. 7 is a flow chart of a method in accordance with embodiments disclosed herein.

Referring to FIG. 7, a method in accordance with one or more embodiments disclosed herein is shown. The method includes running a lock mandrel into a subterranean wellbore, as shown at 760, and positioning the lock mandrel in a landing nipple located at a specified depth in the subterranean wellbore, as shown at 762. A signal is transmitted to a control unit coupled to the landing nipple to activate data acquisition from a sensor disposed on the landing nipple, as shown at 764. The sensor may include one or more of a microstrain sensor and a pressure sensor as described in detail above. The control unit acquires data representative of a pressure or a strain associated with the landing nipple from the sensor, as shown at 766. The data representative of the pressure or the strain associated with the landing nipple is transmitted to a system at a surface of the wellbore, as shown at 768. Based on the data representative of the pressure or the strain associated with the landing nipple, a position of the lock mandrel within the landing nipple may be determined at 770. In some embodiments, the data may be transmitted from the control unit as raw data to the system at the surface, where the system processes the data. In some embodiments, the control unit may process the data and send an indication to the surface of a failure of setting of the lock mandrel or an indication of a correctly set lock mandrel.

As discussed above, the position of the lock mandrel within the landing nipple may be determined from pressure data above and below the packing element (isolation of the well across the landing nipple) or strain data (stain indicative of engagement of the external locking profile of the lock mandrel with the internal locking profile of the landing nipple). A signal may be transmitted from the surface to the control unit to deactivate data acquisition from the sensor. If the data representative of the pressure or the strain indicates that the lock mandrel is not correctly set within the landing nipple, the lock mandrel may be mechanically unset and reset within the landing nipple. A signal from the surface to the control unit to activate data acquisition may be again transmitted, via Wi-Fi transmission or electromagnetic transmission, and data representative of the pressure or the strain associated with the landing nipple may be transmitted to the system at the surface. Based on the data representative of the pressure or the strain associated with the landing nipple after the lock mandrel has been reset, the position of the lock mandrel within the landing nipple may again be determined. These steps may be repeated until the position of the lock mandrel within the landing nipple is determined to be correctly landed within the landing nipple. These steps may also be repeated for each landing nipple within a wellbore.

Data representative of an internal temperature of the landing nipple may also be acquired by the control unit and transmitted to the system at the surface of the wellbore in the same manner as described with respect to the data representative of an internal pressure or a strain of the landing nipple. In this way, the method in accordance with embodiments disclosed herein may provide for a full diagnostic of the landing nipple and lock mandrel in real time and identify any potential failures while setting.

An apparatus or method in accordance with embodiments disclosed herein may advantageously allow for ensuring the correct setting of a slickline plug/lock mandrel inside a landing nipple. Additionally, embodiments disclosed herein provide for real time pressure and temperature readings inside the landing nipple above and below the sealing element or packing element of the slickline plug/lock mandrel. Further, embodiments disclosed herein may ensure the integrity of the system by ensuring complete well control isolation as provided by the lock mandrel engaged within the landing nipple. Accordingly, the need for a check set tool run on an additional slickline to ensure correct setting of the slickline plug/lock mandrel may be avoided, as well as fishing operations for a dropped slickline plug/lock mandrel due to incorrect setting within the landing nipple.

While the method and apparatus have been described with respect to a limited number of embodiments, those skilled in the art, having benefit of this disclosure, will appreciate that other embodiments can be devised which do not depart from the scope as disclosed herein. Accordingly, the scope should be limited only by the attached claims.

What is claimed is:

1. A method comprising:

running a lock mandrel into a subterranean wellbore;

setting the lock mandrel in a landing nipple located at a specified depth in the subterranean wellbore;

acquiring data from a sensor disposed on the landing nipple with a control unit, the data comprising information regarding a pressure or a strain associated with the landing nipple and representative of a position of the lock mandrel in the landing nipple;

transmitting the data in real time from the control unit to a surface of the wellbore; and determining a position of the lock mandrel in the landing nipple based on the transmitted data, the determining the position of the lock mandrel in the landing nipple comprising detecting contact of the lock mandrel on an internal locking profile of the landing nipple.

2. The method of claim 1, further comprising activating or deactivating a signal transmission between the sensor disposed on the landing nipple and configured to detect the data and the control unit, the control unit in communication with a system at the surface.

3. The method of claim 2, wherein the control unit is in communication with the system at the surface via Wi-Fi transmission or electromagnetic transmission.

4. The method of claim 1, further comprising determining isolation of the well below the landing nipple from above the landing nipple.

5. The method of claim 1, further comprising determining a first temperature above the landing nipple and a second temperature below the landing nipple.

6. The method of claim 1, further comprising determining a first pressure above the landing nipple and a second pressure below the landing nipple.

7. The method of claim 1, further comprising identifying a potential failure while setting the lock mandrel in the landing nipple.

8. The method of claim 1, wherein the sensor is a microstrain sensor disposed on an external portion of the landing nipple, and wherein the detecting contact of the lock mandrel on the internal locking profile comprises using the microstrain sensor disposed on the external portion of the landing nipple.

9. The method of claim 1, further comprising:

determining, based on the data transmitted to the surface, the lock mandrel is mis-set in the landing nipple;

mechanically unsetting and resetting the lock mandrel in the landing nipple; and acquiring second data with the control unit, the second data comprising information regarding the position of the lock mandrel in the landing nipple after resetting the lock mandrel; and transmitting the second data in real time from the control unit to a surface of the wellbore.

10. The method of claim 1, further comprising transmitting data by the control unit to the surface using transmitters.

11. The method of claim 1, further comprising receiving data by the control unit from the surface using receivers.

12. An apparatus comprising:

a landing nipple having an internal locking profile;

a lock mandrel having an external locking profile configured to engage the internal locking profile of the landing nipple;

a sensor disposed on the landing nipple, the sensor configured to determine a pressure or a strain associated with the landing nipple; and a control unit coupled to the landing nipple and configured to receive data from the sensor and transmit the received data to a surface of the wellbore in real time, wherein signal transmissions between the sensor and the control unit are configured to be activated and deactivated.

13. The apparatus of claim 12, wherein the lock mandrel further comprises a packing element disposed around an outer circumferential portion, a first temperature sensor, and a second temperature sensor, wherein the first temperature sensor is disposed on an inner portion of the landing nipple at a first axial location above the packing element when the lock mandrel is set in the landing nipple, and wherein the second temperature sensor is disposed on the inner portion of the landing nipple at second axial location below the packing element when the lock mandrel is set in the landing nipple.

14. The apparatus of claim 12, wherein the lock mandrel comprises a packing element disposed around an outer circumferential portion, wherein the sensor comprises a first pressure sensor and a second pressure sensor, wherein the first pressure sensor is disposed on an inner portion of the landing nipple at a first axial location above the packing element when the lock mandrel is set in the landing nipple, and wherein the second pressure sensor is disposed on the inner portion of the landing nipple at a second axial location below the packing element when the lock mandrel is set in the landing nipple.

15. The apparatus of claim 12, wherein the sensor comprises a microstrain sensor disposed on an external portion of the landing nipple.

16. The apparatus of claim 15, wherein the microstrain sensor comprises a piezoelectric sensor.

17. A method comprising:

running a lock mandrel into a subterranean wellbore;

positioning the lock mandrel in a landing nipple located at a specified depth in the subterranean wellbore;

transmitting a signal to a control unit coupled to the landing nipple to activate data acquisition from a sensor disposed on the landing nipple;

acquiring data representative of a pressure or a strain associated with the landing nipple from the sensor;

transmitting the data representative of the pressure or the strain associated with the landing nipple to a system at a surface of the wellbore in real time; and determining, based on the data representative of the pressure or the strain associated with the landing nipple, a position of the lock mandrel within the landing nipple.

18. The method of claim 17, further comprising transmitting a signal to the control unit to deactivate data acquisition from the sensor.

19. The method of claim 18, further comprising repeating the transmitting the signal to the control unit to activate data acquisition, the acquiring data representative of the pressure or the strain associated with the landing nipple, the transmitting the data representative of the pressure or the strain associated with the landing nipple to the system at the surface, the determining, based on the data representative of the pressure or the strain associated with the landing nipple, the position of the lock mandrel within the landing nipple, and the transmitting a signal to the control unit to deactivate data acquisition from the sensor until the position of the lock mandrel within the landing nipple is determined to be correctly landed within the landing nipple.

20. The apparatus of claim 12, wherein the control unit is directly coupled to the landing nipple or integrally formed with the landing nipple.

* * * * *